US010809646B2

(12) United States Patent
Itou et al.

(10) Patent No.: US 10,809,646 B2
(45) Date of Patent: Oct. 20, 2020

(54) TONER CARTRIDGE AND IMAGE FORMING APPARATUS

(71) Applicant: TOSHIBA TEC KABUSHIKI KAISHA, Shinagawa-ku, Tokyo (JP)

(72) Inventors: Tsuyoshi Itou, Izunokuni Shizuoka (JP); Kazuhisa Takeda, Kannami Tagata Shizuoka (JP); Masahiro Ikuta, Kannami Tagata Shizuoka (JP); Takafumi Hara, Nagaizumi Sunto Shizuoka (JP); Hiromichi Mitamura, Izu Shizuoka (JP); Shigeru Fujiwara, Yokohama Kanagawa (JP); Hisanobu Ajima, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/430,476

(22) Filed: Jun. 4, 2019

(65) Prior Publication Data

US 2019/0377281 A1 Dec. 12, 2019

Related U.S. Application Data

(60) Provisional application No. 62/682,058, filed on Jun. 7, 2018.

(30) Foreign Application Priority Data

Mar. 26, 2019 (JP) ..... 2019-058992

(51) Int. Cl.
*G03G 15/08* (2006.01)

(52) U.S. Cl.
CPC ..... *G03G 15/0855* (2013.01); *G03G 15/0863* (2013.01)

(58) Field of Classification Search
CPC ..... G03G 15/0849; G03G 15/0855; G03G 15/0863; G03G 15/5058; G03G 15/6585; G03G 21/1889; G03G 21/1892
See application file for complete search history.

(56) References Cited

U.S. PATENT DOCUMENTS

2004/0105689 A1* 6/2004 Shimura ..... G03G 15/0863 399/12
2005/0063715 A1* 3/2005 Suzuki ..... G03G 15/0822 399/27

(Continued)

FOREIGN PATENT DOCUMENTS

JP 5418128 2/2014

OTHER PUBLICATIONS

Extended European Search Report for European Patent Application No. 19178152.5 dated Oct. 25, 2019.

*Primary Examiner* — Francis C Gray
(74) *Attorney, Agent, or Firm* — Amin, Turocy & Watson LLP

(57) ABSTRACT

According to one embodiment, there is provided a toner cartridge used in an image forming apparatus including a processor which forms a toner pattern image on a photoconductive member, transfers the toner pattern image on a medium, and changes an image forming condition based on a detection result obtained by optically detecting the toner pattern image transferred onto the medium, the toner cartridge including: a toner accommodating container accommodating a toner, and a memory. The memory stores reference data which is determined according to toner characteristics in the toner accommodating container, and is used for applying a reference value for an optical detection result of a toner pattern formed by the toner on the medium.

20 Claims, 6 Drawing Sheets

(56) References Cited

U.S. PATENT DOCUMENTS

| | | | | |
|---|---|---|---|---|
| 2006/0165425 | A1* | 7/2006 | Matayoshi | G03G 15/5058 399/49 |
| 2008/0285993 | A1* | 11/2008 | Ishida | G03G 15/0893 399/58 |
| 2010/0157339 | A1* | 6/2010 | Yamada | H04N 1/0009 358/1.9 |
| 2011/0279835 | A1* | 11/2011 | Tanaka | H04N 1/40037 358/1.9 |
| 2013/0222456 | A1* | 8/2013 | Ogawa | B41J 11/007 347/16 |
| 2013/0236196 | A1* | 9/2013 | Shinohara | G03G 15/0863 399/12 |
| 2015/0355572 | A1* | 12/2015 | Saitoh | G03G 15/0849 399/30 |

* cited by examiner

FIG. 4

| DIVISION | SPEED CLASSIFICATION | LIFE (NUMBER OF PRINTED SHEETS) | ATC OUTPUT CORRECTING CONTROL VALUE |
|---|---|---|---|
| 1 | NORMAL | 0-5000 | 0 |
| 2 | NORMAL | 5001-10000 | -5 |
| 3 | NORMAL | 10001-20000 | -10 |
| 4 | NORMAL | 20001-30000 | -15 |
| 5 | DECELERATION | 0-5000 | 0 |
| 6 | DECELERATION | 5001-10000 | -3 |
| 7 | DECELERATION | 10001-20000 | -8 |
| 8 | DECELERATION | 20001-30000 | -12 |

FIG. 5

| | TONER PARTICLE DIAMETER (μm) | TONER PATTERN CONCENTRATION MEASURING REFERENCE VALUE |
|---|---|---|
| table 1 | 12.5 | 200 |
| table 2 | 11.0 | 250 |
| table 3 | 9.5 | 300 |

TONER CARTRIDGE AND IMAGE FORMING APPARATUS

CROSS-REFERENCE TO RELATED APPLICATION

The present application is based upon and claims the benefit of priorities from U.S. Provisional Application No. 62/682,058 filed on Jun. 7, 2018 and Japanese Patent Application No. 2019-058992 filed on Mar. 26, 2019, the entire contents of both of which are hereby incorporated by reference.

FIELD

Embodiments described herein relate generally to a toner cartridge and an image forming apparatus.

BACKGROUND

In an image forming apparatus for performing two-component development, a developer including a toner and a carrier is accommodated in a developing device, and development is performed by the toner. When a toner concentration in the developing device decreases as the toner is consumed, the image forming apparatus supplies the toner from a toner cartridge to the developing device. The image forming apparatus transfers a toner image of a photoconductive drum to a print medium.

Image forming conditions also need to consider toner characteristics. The toner characteristics may also vary depending on a production lot of the toner. Therefore, the toner cartridge is practically used, which includes a memory storing image forming condition data (control data) in accordance with the toner characteristics of the toner accommodated in the toner cartridge. The image forming apparatus acquires control data such as a charging bias voltage and a developing bias voltage from the memory of the toner cartridge, and performs an image forming process based on the acquired control data.

However, even if the image forming process is performed based on the control data acquired as described above, an effect of improving image quality may not be sufficiently obtained depending on a state of the image forming apparatus. In particular, when a special toner such as a decolorable toner is used, the toner characteristics thereof are largely different from toner characteristics of the related art, and sufficient image quality may not be maintained in the same control as that of the toner of the related art.

DESCRIPTION OF THE DRAWINGS

FIG. 4 is a table for explaining an example of an ATC sensor output correcting control value table according to an embodiment.

FIG. 5 is a table for explaining an example of a toner pattern concentration measuring reference value table according to an embodiment.

DETAILED DESCRIPTION

An object of an exemplary embodiment is to provide a toner cartridge and an image forming apparatus capable of realizing high image quality.

In general, according to one embodiment, there is provided a toner cartridge used in an image forming apparatus including a processor which forms a toner pattern image on a photoconductive member, transfers the toner pattern image on a medium, and changes an image forming condition based on a detection result obtained by optically detecting the toner pattern image transferred onto the medium, the toner cartridge including: a toner accommodating container accommodating a toner; and a memory. The memory stores reference data which is determined according to toner characteristics in the toner accommodating container, and is used for applying a reference value for an optical detection result of a toner pattern formed by the toner on the medium.

Hereinafter, a toner cartridge and an image forming apparatus according to an embodiment will be described with reference to the drawings.

Figure 1:
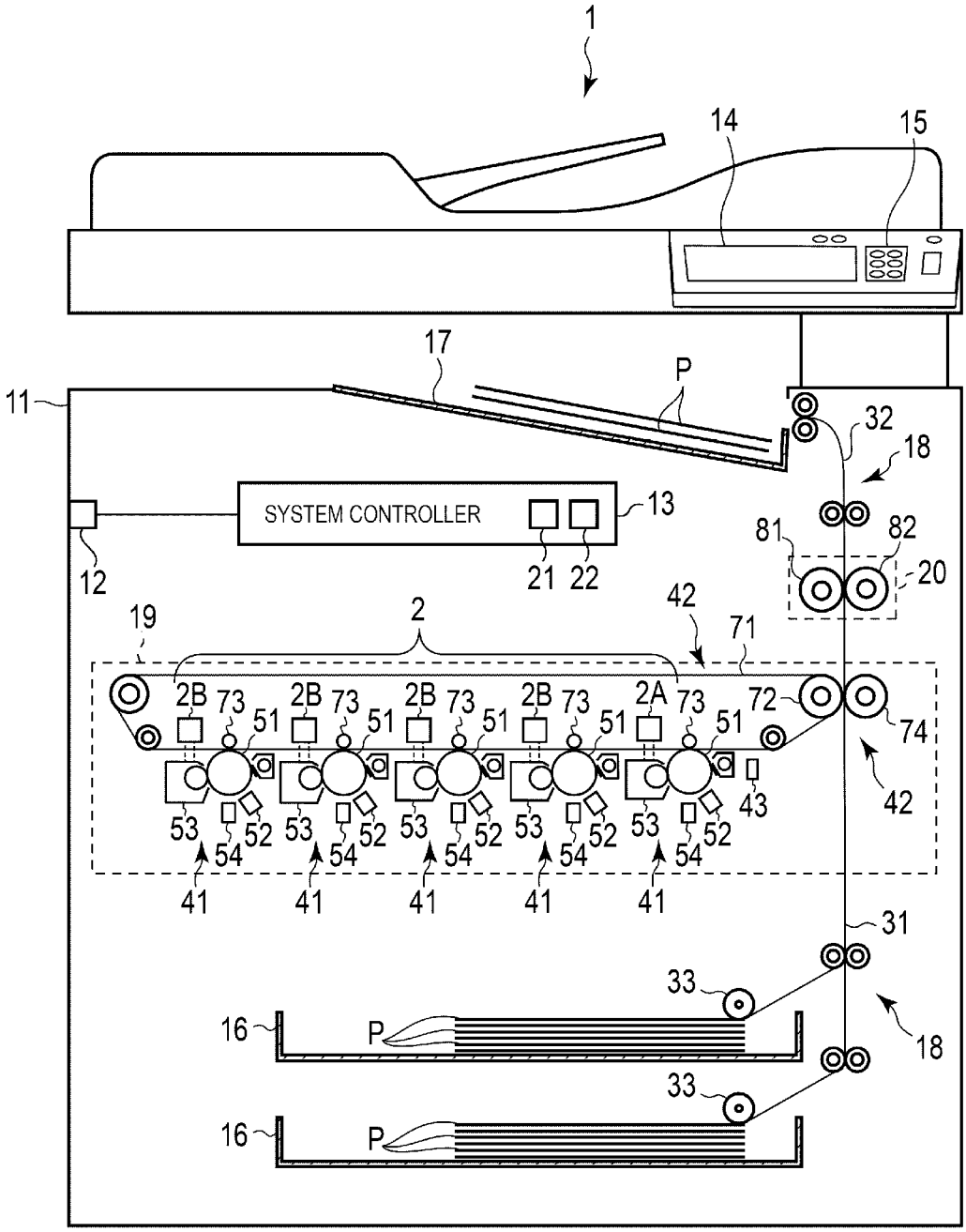
FIG. 1 is a view for explaining a configuration example of an image forming apparatus according to an embodiment.
Figure 2:
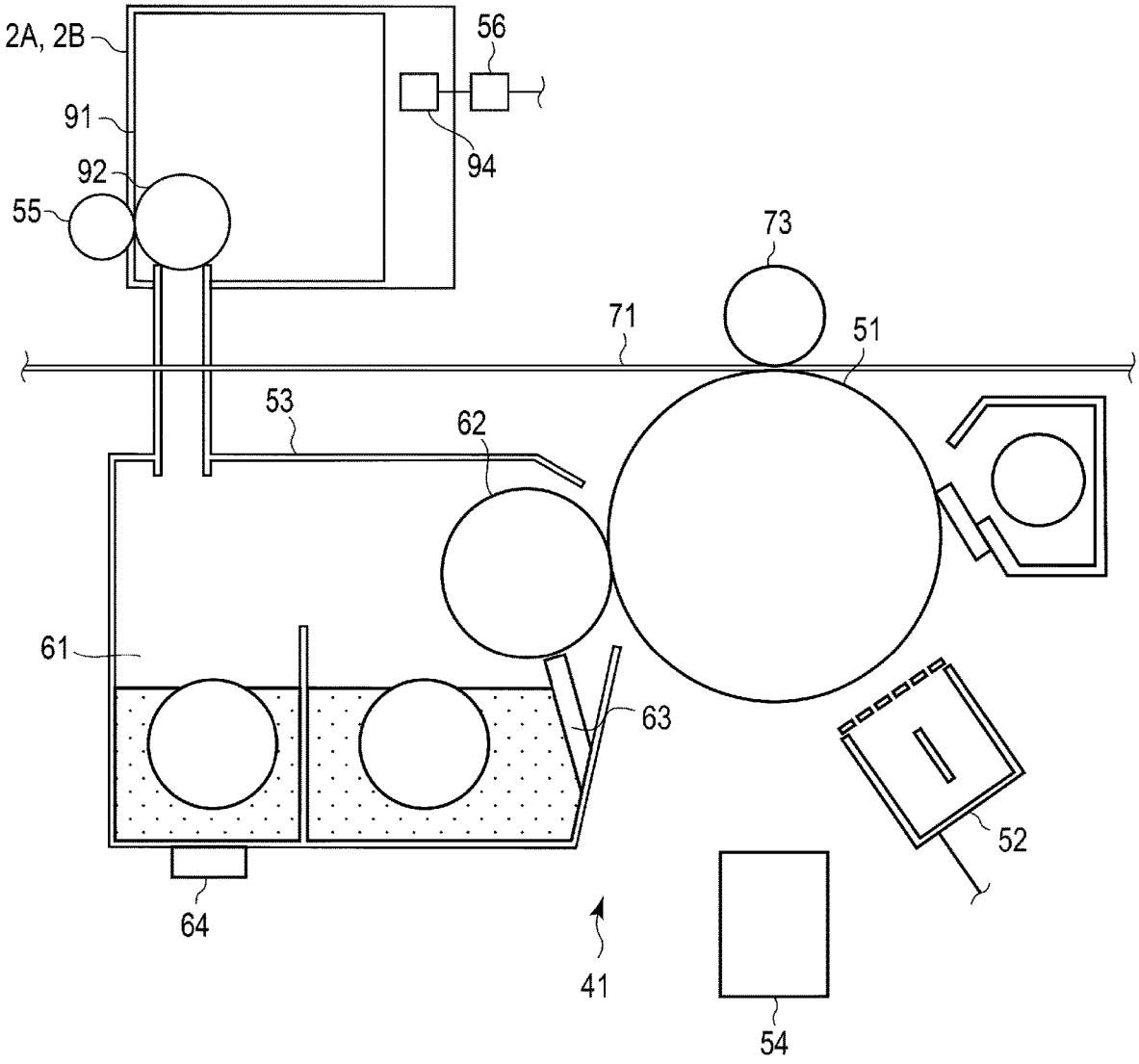
FIG. 2 is a view for explaining a configuration example of a process unit of the image forming apparatus according to an embodiment.

FIG. 1 is a view for explaining a configuration example of an image forming apparatus 1 according to an embodiment. FIG. 2 is a view for explaining a configuration example of a part of the image forming apparatus 1.

The image forming apparatus 1 is, for example, a multifunction peripheral (MFP) that performs various processes such as image forming while carrying a recording medium such as a print medium.

For example, the image forming apparatus 1 includes a configuration in which a toner is replenished from a toner cartridge 2 and an image is formed on the print medium. The image forming apparatus 1 of the embodiment includes two types of toners of a decolorable toner and a non-decolorable toner. The decolorable toner is colored in blue. The non-decolorable toner is, for example, a toner selected from cyan, magenta, yellow, black, and the like. The image forming apparatus selects one toner and forms a single color image with the toner on the print medium. A decolorable toner can be erased under certain predetermined conditions while a non-decolorable toner cannot be erased under those conditions, as the non-decolorable toner is often considered a permanent toner.

As illustrated in FIG. 1, the image forming apparatus 1 includes a housing 11, a communication interface 12, a system controller 13, a display unit 14, an operation interface 15, a plurality of sheet trays 16, a paper discharge tray 17, a carrying unit 18, an image forming unit 19, and a fixing device 20.

The housing 11 is a body of the image forming apparatus 1. The housing 11 accommodates the communication interface 12, the system controller 13, the display unit 14, the operation interface 15, the plurality of sheet trays 16, the paper discharge tray 17, the carrying unit 18, the image forming unit 19, and the fixing device 20.

The communication interface 12 is an interface for communicating with other devices. The communication interface 12 is used, for example, for communicating with a host device (external device). The communication interface 12 is configured as, for example, a LAN connector, or the like.

The communication interface 12 may perform wireless communication with another device in accordance with a standard such as Bluetooth (registered trademark) or Wi-Fi (registered trademark).

The system controller 13 controls the image forming apparatus 1. The system controller 13 includes, for example, a processor 21 and a memory 22. The system controller 13 is connected to the carrying unit 18, the image forming unit 19, the fixing device 20, and the like via a bus or the like.

The processor 21 is an arithmetic element that executes an arithmetic process. The processor 21 is, for example, a CPU. The processor 21 performs various processes based on data such as programs stored in the memory 22. The processor 21 functions as a control unit capable of executing various operations by executing programs stored in the memory 22.

The memory 22 is a storage medium storing a program, data used in the program, and the like. In addition, the memory 22 also functions as a working memory. That is, the memory 22 temporarily stores data being processed by the processor 21, a program executed by the processor 21, or the like.

The processor 21 controls the carrying unit 18, the image forming unit 19, and the fixing device 20 by executing programs stored in the memory 22. The processor 21 executes a program stored in the memory 22 to generate a print job for forming an image on a print medium P. For example, the processor 21 generates the print job based on an image acquired from an external device, for example, via the communication interface 12. The processor 21 stores the generated print job in the memory 22.

The print job includes image data indicating an image formed on the print medium P. The image data may be data for forming an image on one print medium P, or may be data for forming images on a plurality of print media P. The print job includes information indicating whether color printing or monochrome printing is performed.

The display unit 14 includes a display that displays a screen according to a video signal input from a display control unit such as the system controller 13 or a graphic controller (not illustrated). For example, screens for various settings of the image forming apparatus 1 are displayed on the display of the display unit 14.

The operation interface 15 is connected to an operation member (not illustrated). The operation interface 15 supplies an operation signal according to an operation of the operation member to the system controller 13. The operation member is, for example, a touch sensor, a ten key, a power source key, a sheet feed key, various function keys, a keyboard, or the like. The touch sensor acquires information indicating a position designated in a certain area. The touch sensor is configured as a touch panel integrally with the display unit 14 to input a signal indicating a position touched on a screen displayed on the display unit 14 into the system controller 13.

Each of the plurality of sheet trays 16 is a cassette for accommodating the print medium P. The sheet tray 16 is configured to be able to supply the print medium P from an outside of the housing 11. For example, the sheet tray 16 is configured to be pulled out from the housing 11.

The paper discharge tray 17 is a tray that supports the print medium. P discharged from the image forming apparatus 1.

The carrying unit 18 is a mechanism for carrying the print medium P in the image forming apparatus 1. As illustrated in FIG. 1, the carrying unit 18 includes a plurality of carrying paths. For example, the carrying unit 18 includes a paper feed carrying path 31 and a paper discharge carrying path 32.

The paper feed carrying path 31 and the paper discharge carrying path 32 are respectively configured by a plurality of motors, a plurality of rollers, and a plurality of guides which are not illustrated. The plurality of motors rotate shafts based on the control of the system controller 13 to rotate rollers in conjunction with the rotation of the shafts. The plurality of rollers move the print medium P by rotating. The plurality of guides control a carrying direction of the print medium P.

The paper feed carrying path 31 takes in the print medium P from the sheet tray 16 and supplies the taken-in print medium P to the image forming unit 19. The paper feed carrying path 31 includes a pickup roller 33 corresponding to each of the sheet trays. Each pickup roller 33 takes the print medium P of each of the sheet trays 16 into the paper feed carrying path 31.

The paper discharge carrying path 32 is a carrying path for discharging the print medium P, on which an image is formed, from the housing 11. The print medium P discharged by the paper discharge carrying path 32 is supported by the paper discharge tray 17.

Next, the image forming unit 19 will be described.

The image forming unit 19 is configured to form an image on the print medium P based on the control of the system controller 13. Specifically, the image forming unit 19 forms an image on the print medium P based on the print job generated by the processor 21. The image forming unit 19 includes a plurality of process units 41, a transfer mechanism 42, and a concentration sensor 43.

First, a configuration regarding image formation of the image forming unit 19 will be described.

The plurality of process units 41 respectively correspond to the decolorable toner and cyan toner, magenta toner, yellow toner, and black toner which are the non-decolorable toners. The toner cartridges 2 including toners of different colors are respectively connected to the process units 41. The plurality of process units 41 include the same configuration except for the developer to be charged, so one process unit 41 will be described.

FIG. 2 is a view for explaining a configuration example of the process unit 41. The process unit 41 includes a photoconductive drum 51, an electrostatic charger 52, and a developing device 53.

In addition, the image forming unit 19 includes a plurality of exposure devices 54, a plurality of toner replenishment motors 55, and a plurality of communication interfaces 56. The exposure device 54, the toner replenishment motor 55, and the communication interface 56 are provided for each of the process units 41.

The photoconductive drum 51 is a photoconductive member including a cylindrical drum and a photoconductive layer formed on an outer peripheral surface of the drum. The photoconductive drum 51 is rotated at a constant speed by a drive mechanism (not illustrated).

The electrostatic charger 52 uniformly charges a surface of the photoconductive drum 51. For example, the electrostatic charger 52 applies a voltage (developing bias voltage) to the photoconductive drum 51 using a charging roller to charge the photoconductive drum 51 with a uniform negative potential (contrast potential). The charging roller is rotated by the rotation of the photoconductive drum 51 in a state where a predetermined pressure is applied to the photoconductive drum 51.

The developing device 53 is a device that causes the toner to adhere to the photoconductive drum 51. The developing device 53 includes a developer container 61, a developing roller 62, a doctor blade 63, an automatic toner control sensor (ATC sensor) 64, and the like.

The developer container 61 is a container for accommodating a developer including the toner and the carrier. The toner is replenished from the toner cartridge 2. The developing roller 62 carries the developer on the surface by being rotated in the developer container. The doctor blade 63 is a member disposed at a predetermined distance from the developing roller 62. The doctor blade 63 adjusts a thickness of the developer carried on the developing roller 62.

The ATC sensor 64 is, for example, a magnetic sensor that includes a coil and measures a voltage value (ATC sensor measurement voltage) generated in the coil. The ATC sensor 64 measures the toner concentration in the developer in the developer container 61 of the developing device 53. That is, the ATC sensor 64 measures a change in magnetic flux according to a change in toner concentration in the developer container 61 as the ATC sensor measurement voltage generated in the coil. The ATC sensor 64 supplies the ATC sensor measurement voltage to the system controller 13. An amount of the toner in the developer container 61 is reflected in the ATC sensor measurement voltage. That is, the system controller 13 can determine the concentration of the toner remaining in the developer container 61 based on the ATC sensor measurement voltage, and can determine whether or not toner replenishment is necessary. The toner is replenished from the toner cartridge 2 to the developer container 61 based on the ATC sensor measurement voltage.

The exposure device 54 includes a plurality of light emitting elements. The exposure device 54 forms a latent image on the photoconductive drum 51 by irradiating the photoconductive drum 51 with light from the light emitting element based on the control of the system controller 13. The light emitting element is a light emitting diode (LED) or the like. One light emitting element is configured to irradiate one point on the photoconductive drum 51 with the light. The plurality of light emitting elements are arranged in a main scanning direction that is a direction parallel to a rotation axis of the photoconductive drum 51.

The exposure device 54 forms a latent image of one line on the photoconductive drum 51 by irradiating the photoconductive drum 51 with the light by the plurality of light emitting elements arranged in the main scanning direction. Furthermore, the exposure device 54 forms a latent image by continuously irradiating the rotating photoconductive drum 51 with the light.

The toner replenishment motor 55 causes the toner cartridge 2 to supply the toner to the developing device 53 by rotating a screw of the toner cartridge 2. The toner replenishment motor 55 rotates a drive mechanism (not illustrated). The drive mechanism is coupled to a screw of the toner cartridge 2 described later when the toner cartridge 2 is mounted on the image forming apparatus 1. The screw rotates in conjunction with the rotation of the drive mechanism.

The communication interface 56 is an interface for communicating with the toner cartridge 2.

In the above configuration, when the surface of the photoconductive drum 51 charged by the electrostatic charger 52 is irradiated with the light from the exposure device 54, an electrostatic latent image is formed on the surface thereof. When a developer layer formed on the surface of the developing roller 62 approaches the photoconductive drum 51, the toner included in the developer adheres to the latent image formed on the surface of the photoconductive drum. Therefore, the process unit 41 forms a toner image on the surface of the photoconductive drum 51.

According to the above configuration, the processor 21 of the system controller 13 calculates the toner concentration in the developer container 61 of the developing device 53 based on a predetermined reference value (ATC sensor reference value) and an output of the ATC sensor measurement voltage supplied from the ATC sensor 64. The processor 21 performs toner replenishment necessity determining of determining a necessity of the toner replenishment from the toner cartridge 2 based on the calculated toner concentration.

When the processor 21 determines that an amount of the toner in the developer container 61 of the developing device 53 decreases in the toner replenishment necessity determining, the toner is supplied from the toner cartridge 2 to the developing device 53 by controlling an operation of the toner replenishment motor 55.

The transfer mechanism 42 is configured to transfer the toner image formed on the surface of the photoconductive drum 51 to the print medium P. The transfer mechanism 42 includes, for example, a primary transfer belt 71, a secondary transfer opposing roller 72, a plurality of primary transfer rollers 73, and a secondary transfer roller 74.

The primary transfer belt 71 is an endless belt wound around the secondary transfer opposing roller 72 and a plurality of winding rollers. The primary transfer belt 71 has an inner surface (inner peripheral surface) being in contact with the secondary transfer opposing roller 72 and the plurality of winding rollers, and an outer surface (outer peripheral surface) facing the photoconductive drum 51 of the process unit 41.

The secondary transfer opposing roller 72 is rotated by a motor (not illustrated). The secondary transfer opposing roller 72 is rotated to carry the primary transfer belt 71 in a predetermined carrying direction. The plurality of winding rollers are configured to be freely rotatable. The plurality of winding rollers rotate in accordance with the movement of the primary transfer belt 71 by the secondary transfer opposing roller 72.

The plurality of primary transfer rollers 73 are configured to cause the photoconductive drum 51 of the process unit 41 to come into contact with the primary transfer belt 71. The plurality of primary transfer rollers 73 are provided to correspond to the photoconductive drums 51 of the plurality of process units 41. Specifically, each of the plurality of primary transfer rollers 73 is provided at a position facing the corresponding photoconductive drum 51 of the process unit 41 with the primary transfer belt 71 interposed therebetween. The primary transfer roller 73 comes into contact with an inner peripheral surface side of the primary transfer belt 71 and displaces the primary transfer belt 71 to a photoconductive drum 51 side. Therefore, the primary transfer roller 73 causes the outer peripheral surface of the primary transfer belt 71 to come into contact with the photoconductive drum 51.

The secondary transfer roller 74 is provided at a position facing the primary transfer belt 71. The secondary transfer roller 74 comes into contact with the outer peripheral surface of the primary transfer belt 71 and applies a pressure to the primary transfer belt 71. Therefore, a transfer nip is formed in which the secondary transfer roller 74 comes into close contact with the outer peripheral surface of the primary transfer belt 71. When the print medium P passes through the transfer nip, the secondary transfer roller 74 causes the print medium P passing through the transfer nip to press against the outer peripheral surface of the primary transfer belt 71.

The secondary transfer roller 74 and the secondary transfer opposing roller 72 rotate to carry the print medium P supplied from the paper feed carrying path 31 in a pinched state. Therefore, the print medium P passes through the transfer nip.

Figure 3:
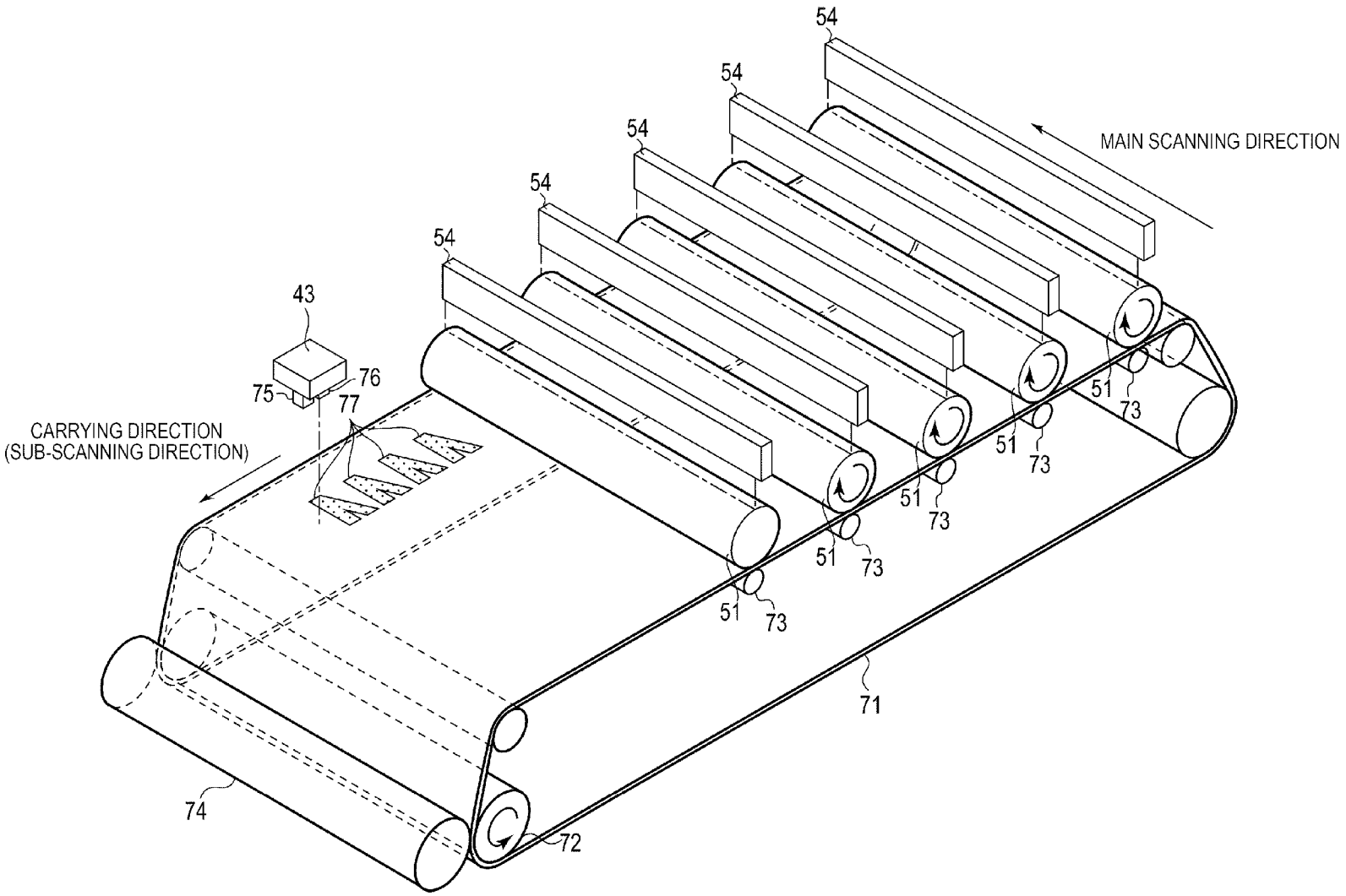
FIG. 3 is a view for explaining a configuration example of a periphery of a primary transfer belt of the image forming apparatus according to an embodiment.

The toner image formed on the surface of the photoconductive drum is transferred to the outer peripheral surface of the primary transfer belt 71. As illustrated in FIG. 3, if the image forming unit 19 includes the plurality of process units 41, the primary transfer belt 71 receives the toner image from the photoconductive drums 51 of the plurality of process units 41. The toner image transferred to the outer peripheral surface of the primary transfer belt 71 is carried to the transfer nip in which the secondary transfer roller 74 comes into close contact with the outer peripheral surface of the primary transfer belt 71 by the primary transfer belt 71. When the print medium P exists in the transfer nip, the toner image transferred to the outer peripheral surface of the primary transfer belt 71 is transferred to the print medium P in the transfer nip.

The processor 21 forms toner pattern images of different concentrations on the primary transfer belt 71 by each of the process units 41 for each toner, and adjusts an image forming condition by measuring the concentration of the toner pattern image.

The concentration sensor 43 measures the concentration of the toner pattern image transferred to the outer peripheral surface of the primary transfer belt 71. The concentration sensor 43 includes a lighting unit 75 for irradiating the primary transfer belt 71 with the light, and an image sensor 76 for detecting the light from the outer peripheral surface of the primary transfer belt 71. In addition, the concentration sensor 43 may further include an optical system that causes the light from the outer peripheral surface of the primary transfer belt 71 to form an image on the image sensor 76. The concentration sensor 43 detects a reflected light reflected from the toner pattern image at a detection position on the outer peripheral surface of the primary transfer belt 71 by the image sensor 76. Therefore, the concentration sensor 43 optically measures the concentration of a test pattern 77 formed by the toner image on the outer peripheral surface of the primary transfer belt 71, and acquires a measurement voltage. The concentration sensor 43 supplies a concentration sensor measurement voltage to the system controller 13. The concentration sensor 43 may be configured of a plurality of sensors that detect the toner images at a plurality of different positions in the main scanning direction.

Next, a configuration regarding fixing of the image forming apparatus 1 will be described.

The fixing device 20 fixes the toner image on the print medium P to which the toner image is transferred. The fixing device 20 operates based on the control of the system controller 13. The fixing device 20 includes a heating member that applies heat to the print medium P, and a pressure member that applies a pressure to the print medium P. For example, the heating member is a heat roller 81. In addition, for example, the pressure member is a press roller 82.

The heat roller 81 is a fixing rotation body which is rotated by a motor (not illustrated). The heat roller 81 includes a hollow core metal made of metal, and an elastic layer formed on an outer periphery of the core metal. The heat roller 81 is heated to a high temperature by a heater disposed inside the hollow core metal. The heater is, for example, a halogen heater. In addition, the heater may be an induction heating (IH) heater which heats the core metal by electromagnetic induction.

The press roller 82 is disposed at a position facing the heat roller 81. The press roller 82 includes a core metal made of metal with a predetermined outer diameter and an elastic layer formed on an outer periphery of the core metal. The press roller 82 applies a pressure to the heat roller 81 by stress applied from a tension member (not illustrated). A nip (fixing nip), in which the press roller 82 comes into close contact with the heat roller 81, is formed by applying a pressure from the press roller 82 to the heat roller 81. The press roller 82 is rotated by a motor (not illustrated). The press roller 82 rotates to move the print medium P entering the fixing nip and press the print medium P against the heat roller 81.

With the above configuration, the heat roller 81 and the press roller 82 apply a heat and a pressure to the print medium P passing through the fixing nip. Therefore, the toner image is fixed to the print medium P passed through the fixing nip. The print medium P passed through the fixing nip is introduced into the paper discharge carrying path 32 and is discharged to the outside of the housing 11.

Next, a configuration of the toner cartridge 2 will be described. The toner cartridge 2 includes a toner cartridge 2A which is a toner cartridge accommodating the decolorable toner, and a toner cartridge 2B which is a toner cartridge accommodating the non-decolorable toner.

As illustrated in FIG. 2, the toner cartridge 2A includes an accommodating container 91, a screw 92, and an IC chip 94. The toner cartridge 2B also includes a hardware configuration similar to the toner cartridge 2A, that is, includes the accommodating container 91, the screw 92, and the IC chip 94. Here, the toner cartridge 2A including the decolorable toner will be described.

The accommodating container 91 is connected to the developer container 61 of the developing device 53 when the toner cartridge 2A is mounted on the image forming apparatus 1.

The screw 92 is a delivery mechanism which is provided in the accommodating container 91 and rotates to deliver the toner in the accommodating container 91 to the developing device 53. The screw 92 is driven by the toner replenishment motor 55 of the process unit 41.

The IC chip 94 is a memory in which various control data are stored in advance. The IC chip 94 may be further configured as a microcomputer including a processor. The IC chip 94 is connected to the communication interface 56 of the image forming apparatus 1 when the toner cartridge 2A is mounted on the image forming apparatus 1. The control data is, for example, an "identification code", an "ATC sensor output correcting control value", a "toner pattern concentration measuring reference value", or the like. An electric terminal of the IC chip 94 may be directly connected to a terminal on the image forming apparatus side.

The "identification code" is provided for identifying the toner cartridge 2 and indicates the model number of the toner cartridge, or the like. The identification code may be a code that distinguishes the decolorable toner and the non-decolorable toner. In addition, the identification code may be a code representing a color of each toner.

The "ATC sensor output correcting control value" is a value used in a process (ATC sensor output correcting) of correcting an output of the ATC sensor. The "ATC sensor output correcting control value" is determined in advance based on characteristics (toner characteristics) of the toner in the accommodating container 91.

The "toner pattern concentration measuring reference value" is a measurement target value when the concentration sensor 43 reads the concentration of the toner pattern image formed on the primary transfer belt, which is used for image quality stabilizing described later. The "toner pattern concentration measuring reference value" is determined in advance and stored based on the characteristics (toner characteristics) of the toner in the accommodating container 91.

Since the concentration sensor 43 is an optical sensor, the reflection of the light, with which the toner pattern is irradiated, is influenced by toner physical properties such as a toner particle diameter and a surface state of the toner. In particular, the toner of the embodiment uses a dye-based colorant, and a coloring concentration thereof is generally lower than that of a toner using a pigment-based colorant. Because the coloring concentration is low, a reflection light amount from the toner pattern detected by the concentration sensor 43 is easily influenced by the toner characteristics such as the toner particle diameter, toner circularity, a surface state (BET specific surface area) of the toner. As a result, a detection result of the sensor tends to fluctuate. On the other hand, in order to increase the coloring concentration, it is conceivable to increase a content amount of the colorant in the toner to make the detection result of the concentration sensor 43 not to be fluctuated. However, in view of a need for toner decoloring, in a case of the decolorable toner, the content amount cannot be significantly increased.

Therefore, in the embodiment, in consideration of the toner characteristics such as the toner particle diameter, the toner circularity, and the surface state (BET specific surface area) of the toner, a pattern concentration measuring reference value is stored in a memory in accordance with the toner. There may be a plurality of toner characteristics to be considered. In addition, the toner pattern concentration measuring reference value may be set based on an actual reflection light amount of the toner.

As the toner characteristics, for example, the toner particle diameter (50% volume average particle diameter), the shape (for example, the circularity, or the like) of the toner, and the BET specific surface area value, and the like can be used.

On the other hand, in the case of the non-decolorable toner, since the material used as the colorant is a material such as carbon black having a high pigment-based coloring concentration, the fluctuation of the detection result by the concentration sensor 43 is smaller than that of the decolorable toner. Therefore, in the IC chip 94 of the toner cartridge 2B accommodating the non-decolorable toner, the toner pattern concentration measuring reference value and the ATC sensor output correcting control value may be stored, but other control data may be stored. For example, the IC chip 94 of the toner cartridge 2B stores development bias voltage data, primary transfer bias voltage, secondary transfer bias voltage, and the like according to a humidity environment. In this case, a reference value of the optical measurement result of the non-decolorable toner is stored in advance in the memory 22 for image quality stabilization control by the non-decolorable toner. The configuration of the toner cartridge 2B accommodating the non-decolorable toner is the same as that of the toner cartridge 2A accommodating the decolorable toner, and has a structure illustrated in FIG. 2, but the control data stored in the IC chip 94 is different.

The decolorable toner was prepared by the following method. First, a binder resin contained in the toner is 95 parts by weight of a polyester-based resin having a weight average molecular weight Mw of 6,300 obtained by polycondensation of terephthalic acid and bisphenol A, and 5 parts by weight of rice wax as a release agent, 1.0 parts by weight of Neogen R (manufactured by Daiichi Kogyo Seiyaku Co., Ltd.), which is an anionic emulsifier, and 2.1 parts by weight of neutralizing agent dimethylaminoethanol were mixed using a high-pressure homogenizer, and binder resin was generated as an atomized dispersion liquid.

Next, a coloring material was obtained by mixing 10 parts by weight of crystal violet lactone (CVL) of leuco dye as a colorant, 10 parts by weight of benzyl 4-hydroxybenzoate as a developer, and 80 parts by weight of 4-benzyloxyphenylethyl lauric acid as a temperature control agent (decolorable agent), heating, and melting. Then, the coloring material was microencapsulated by a coacervation method.

Then, 10 parts by weight of the microencapsulated coloring material, 90 parts by weight of a finely divided dispersion liquid of a binder resin and a wax were coagulated and fused by using aluminum sulfate (Al2 (SO4)3). A fused material was further washed and dried to obtain toner particles. With respect to 100 parts by weight of the particles, 3.5% by weight of hydrophobic silica (SiO2) and 0.5% by weight of titanium oxide (TiO2) were externally added and mixed to obtain a toner.

According to the toner characteristics of the toner generated as described above, the "ATC sensor output correcting control value" and the "toner pattern concentration measuring reference value" are determined and stored in the memory of the IC chip 94 of the toner cartridge 2A.

The IC chip 94 supplies the "identification code", the "ATC sensor output correcting control value", and the "toner pattern concentration measuring reference value" to the image forming apparatus 1. For example, the IC chip 94 supplies the "identification code", the "ATC sensor output correcting control value", and the "toner pattern concentration measuring reference value" to the image forming apparatus 1 when the toner cartridge 2 is mounted on the image forming apparatus 1.

On the other hand, the non-decolorable toner was prepared by the following method.

| | |
|---|---|
| Polyester resin (binder) | 80 parts by weight |
| Crystalline polyester resin | 10 parts by weight |
| Ester wax (A) | 3 parts by weight |
| Colorant (carbon black MA-100) | 6 parts by weight |
| Charge control agent (polysaccharide compound containing Al + Mg) | 1 part by weight |

The above materials were mixed by a Henschel mixer and then melt-kneaded by a biaxial extruder. The obtained melt-kneaded product was cooled, roughly crushed by a hammer mill, finely ground by a jet crusher, and then classified, and powder, of which a volume average diameter is 7 μm, toner Tg is 38.9° C., and a difference between a crystalline polyester melting point and ester wax melting point is 24° C., was obtained. A toner was obtained by externally adding and mixing 3.5% by weight of hydrophobic silica (SiO2) and 0.5% by weight of titanium oxide (TiO2) with respect to 100 parts by weight of the powder.

Since the decolorable toner and the non-decolorable toner are difference in material and manufacturing method, it is preferable to apply control according to the difference in the characteristics.

FIG. 4 is a table for explaining an example of the ATC sensor output correcting control value stored in the memory of the IC chip 94 of the toner cartridge 2A. In the example of FIG. 4, the ATC sensor output correcting control value is stored in the memory of the IC chip 94 as a table (ATC sensor output correcting control value table), in which a "speed classification", a "life (number of printed sheets)", and the "ATC sensor output correcting control value" are associated with each other. The "speed classification" is information indicating either "normal" or "deceleration". The deceleration means that a speed of printing performed on thick paper is slower than that of printing performed on plain paper. The "life (number of printed sheets)" is information (passed sheet threshold) to be compared with the number of passed sheets performed by the image forming apparatus 1. The storage of the ATC sensor output correcting control value in the IC chip 94 is performed, for example, in a manufacturing stage in which the toner cartridge 2A is filled with the toner. The IC chip 94 supplies the ATC sensor output correcting control value table to the image forming apparatus 1. The life is not limited to the number of printed sheets as long as a value representing the image forming execution amount is a value which is directly or indirectly represented. For example, the number of rotations of the photoconductive drum 51 or the screw 92 may be used.

For example, in the example of FIG. 4, if the speed classification is the "normal", the ATC sensor output correcting control value when the life is "0-5000" sheets is set as "0". This indicates that the correction of the ATC sensor reference value using the "ATC sensor output correcting control value" is not performed when the number of printed sheets is within the range of "0-5000" sheets in the speed of the "normal".

In addition, for example, in the example of FIG. 4, if the speed classification is the "normal", the ATC sensor output correcting control value when the life is "5001-10000" sheets is set as "−5". This indicates that when the number of printed sheets is in a range of "5001-10000" sheets in the speed of the "normal", a reference voltage value applied to the ATC sensor is decreased (subtracted) by an amount corresponding to "−5".

FIG. 5 is a table for explaining the toner pattern concentration measuring reference value stored in the memory of the IC chip 94. FIG. 5 illustrates an example of a table (toner pattern concentration measuring reference value table) in which the toner particle diameter [μm] and the toner pattern concentration measuring reference value are associated with each other. The toner pattern concentration measuring reference value, which is selected from the toner pattern concentration measuring reference value table according to the toner particle diameter of the toner with which the accommodating container 91 is filled, is stored in the IC chip 94 of the toner cartridge 2A. The storage of the toner pattern concentration measuring reference value in the IC chip 94 is performed, for example, in a manufacturing stage in which the toner cartridge 2A is filled with the toner.

For example, if the toner particle diameter is 12.5 [μm], the toner pattern concentration measuring reference value "200" is stored in the IC chip 94 of the toner cartridge 2A as the toner pattern concentration measuring reference value. In addition, for example, if the toner particle diameter is 11.0 [μm], a value "250" from the toner pattern concentration measuring reference value table is stored in the IC chip 94 of the toner cartridge 2A as the toner pattern concentration measuring reference value. In addition, if the toner particle diameter is 9.5 [μm], a value "300" from the toner pattern concentration measuring reference value table is stored in the IC chip 94 of the toner cartridge 2A as the toner pattern concentration measuring reference value. As described above, one value is stored in the IC chip 94 as the toner pattern concentration measuring reference value. Here, the toner particle diameter is given as a representative toner characteristic, but the embodiment is not limited to the toner particle diameter. It is important to set an optimal pattern concentration measuring reference value as the decolorable toner in consideration of toner circularity, a surface state (BET specific surface area) of the toner, or the like.

Next, various controls by the processor 21 of the system controller 13 will be described.

When the toner cartridge 2 is mounted on the image forming apparatus 1, the processor 21 reads necessary data from the toner cartridge 2. The processor 21 first reads the "identification code", specifies the model number by the identification code, and determines whether or not the toner cartridge 2 is the one where data is read from the IC chip 94. If it is determined that the toner cartridge 2 is the one to be used in the image forming apparatus 1, the "ATC sensor output correcting control value" and the "toner pattern concentration measuring reference value" are stored in the memory 22.

First, ATC sensor reference value correcting will be described.

The ATC sensor reference value correcting is a process of correcting the ATC sensor reference value used in the toner replenishment necessity determining based on the number of passed sheets. The ATC sensor measurement voltage measured by the ATC sensor 64 changes with various factors such as material deterioration of the developer, and the environment even if a mixing ratio of the toner and the carrier in the developer container 61 is constant. Therefore, the processor 21 executes the ATC sensor reference value correcting of appropriately correcting the ATC sensor reference value in consideration of these factors at a predetermined timing.

Figure 6:
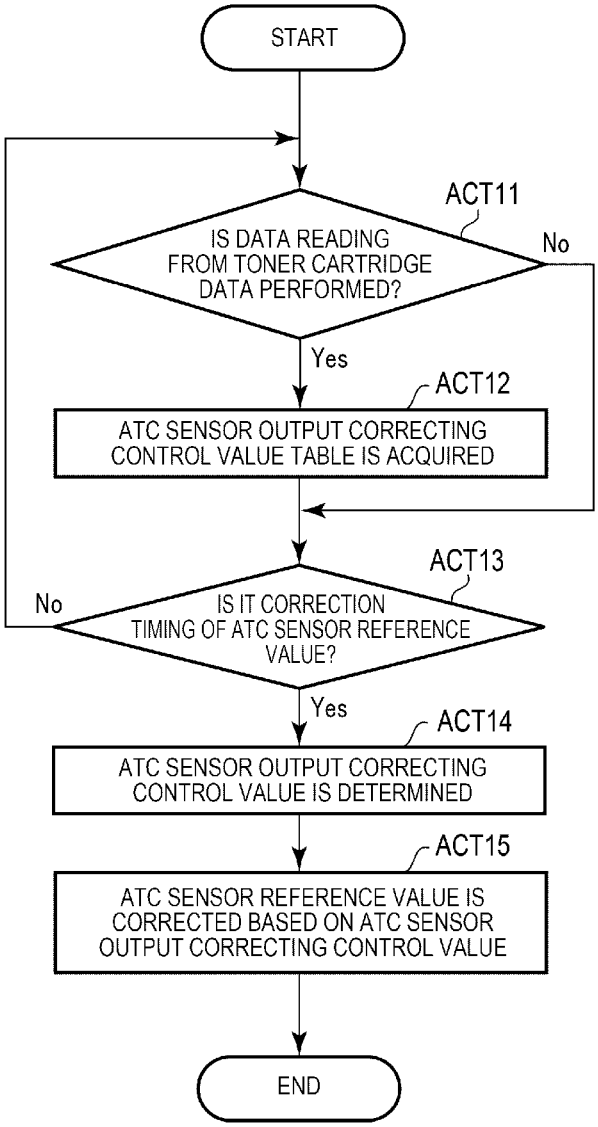
FIG. 6 is a flowchart of a method for explaining an example of ATC sensor reference value correcting according to an embodiment.

FIG. 6 illustrates an example of the ATC sensor reference value correcting. The processor 21 determines whether or not data reading from the toner cartridge 2 is performed (ACT 11). For example, the processor 21 performs authenticating with the toner cartridge 2 when a front cover of the housing 11 is opened and closed, and determines whether or not the data reading from the toner cartridge 2 is performed based on a result of the authenticating.

Specifically, the authenticating is performed in the following procedure. The processor 21 reads the "identification code" from the toner cartridge 2, specifies the model number of the toner cartridge 2 based on the "identification code", and determines whether or not the specified model number of the toner cartridge 2 is that of the toner cartridge 2 to be used in the image forming apparatus 1. If it is determined that the specified model number of the toner cartridge 2 is that of the toner cartridge 2 to be used in the image forming apparatus 1, the processor 21 determines that the result of the authenticating is authentication success. In addition, if it is determined that the specified model number of the toner cartridge 2 is not that of the toner cartridge 2 to be used in the image forming apparatus 1, the processor determines that the result of the authenticating is authentication failure.

If it is determined that the result of the authenticating is the authentication success, the processor 21 determines that data reading from the toner cartridge 2 is performed. In addition, if it is determined that the result of the authenticating is the authentication failure, the processor 21 determines that data reading from the toner cartridge 2 is not performed.

If it is determined that data reading from the toner cartridge 2 is performed (ACT 11, YES), the processor 21 reads the ATC output correcting control value table (or the ATC output correcting control corresponding to the number of sheets passed) from the toner cartridge 2 illustrated in FIG. 4 and stores the table in the memory 22 (ACT 12). In addition, if it is determined that the data reading from the toner cartridge 2 is performed, that is, in the case of the authentication success, the processor 21 may be configured to read the "toner pattern concentration measuring reference value" from the toner cartridge 2, and store the value in the memory 22. Furthermore, the processor 21 may be configured to simultaneously read the ATC sensor output correcting control value table and the toner pattern concentration measuring reference value from the toner cartridge 2, and store those in the memory 22. That is, the processor 21 may be configured to read the ATC sensor output correcting control value table and the toner pattern concentration measuring reference value from the toner cartridge 2 when the authentication with the toner cartridge 2 is successful, and store those in the memory 22.

Next, the processor 21 determines whether or not it is the correction timing of the ATC sensor reference value (ACT 13). For example, the processor 21 counts the number of passed sheets (number of printed sheets) of the image forming apparatus 1, compares the counted value (count value) with the "life (number of printed sheets)" of the ATC sensor output correcting control value table, and determines whether or not it is the correction timing of the ATC sensor reference value based on a comparison result. In the example of FIG. 4, the "life (number of printed sheets)" is configured as a range provided with an upper limit value and a lower limit value. Specifically, the processor 21 sets the lower limit value of each "life (number of printed sheets)" of the ATC sensor output correcting control value table as the passed sheet threshold, and determines that it is the correction timing of the ATC sensor reference value when the count value of the number of passed sheets reaches the passed sheet threshold. Moreover, the processor 21 may be configured to determine that it is the correction timing of the ATC sensor reference value each time the number of sheets set in advance is printed.

If the processor 21 determines that it is not the correction timing of the ATC sensor reference value (ACT 13, NO), the procedure proceeds to ACT 11. Therefore, the processor 21 repeatedly performs the process of ACT 11 to ACT 12 until the correction timing of the ATC sensor reference value is reached.

If the processor 21 determines that it is the correction timing of the ATC sensor reference value (ACT 13, YES), the ATC sensor output correcting control value used for correcting the ATC sensor reference value is determined from the ATC sensor output correcting control value table (ACT 14). For example, the processor 21 determines that the ATC sensor output correcting control value corresponding to the passed sheet threshold used for the determination of ACT 13 is used for correcting the ATC sensor reference value. That is, the processor 21 switches the ATC sensor output correcting control value each time the count value reaches each lower limit value of the "life (number of printed sheets)" of the ATC sensor output correcting control value table.

The processor 21 corrects the ATC sensor reference value based on the determined ATC sensor output correcting control value (ACT 15). For example, the processor 21 determines a sum value of the ATC sensor output correcting control value and the ATC sensor reference value as a new ATC sensor reference value (corrected ATC sensor reference value). The processor 21 stores the corrected ATC sensor reference value in the memory 22.

The processor 21 performs the above toner replenishment necessity determining based on the corrected ATC sensor reference value when the corrected ATC sensor reference value is stored in the memory 22. That is, the processor 21 calculates the toner concentration in the developer container 61 based on the comparison result between the ATC sensor measurement voltage and the corrected ATC sensor reference value. The processor 21 determines the necessity of the toner replenishment from the toner cartridge 2 based on the calculation result of the toner concentration and controls an operation of the toner replenishment motor 55.

Next, the image quality stabilizing will be described.

The image quality stabilizing is performed by acquiring the optical concentration of the toner image formed on the primary transfer belt 71 by the concentration sensor 43, and feeding back the optical concentration to the image forming condition based on the measurement result of the concentration sensor 43.

The image forming apparatus 1 stores in advance a value, which is obtained by optically measuring the concentration (optical concentration) of the surface of the primary transfer belt 71 in which the toner pattern is not formed, measured by the concentration sensor 43, for example, in the memory 22 of the system controller 13.

The processor 21 forms the toner pattern (test pattern 77) on the primary transfer belt 71, and causes the concentration sensor 43 to read the test pattern 77. That is, the concentration sensor 43 outputs a value of the optical concentration of the test pattern 77 on the primary transfer belt 71.

The processor 21 reads the toner pattern concentration measuring reference value read from the IC chip 94 of the toner cartridge 2, from the memory 22 when the authentication of the toner cartridge 2 is performed.

The value of the optical concentration of the surface of the primary transfer belt 71 when the toner pattern is not formed is stored in advance, and the processor 21 calculates a value of a difference between the value of the optical concentration of the test pattern 77 on the primary transfer belt 71 and the value of the optical concentration of the surface of the primary transfer belt 71 when the toner pattern is not formed. The processor 21 performs feedback on the image forming condition based on the calculated difference value and the toner pattern concentration measuring reference value read from the memory 22. For example, the processor 21 performs feedback by changing the image forming condition so that there is no difference between the calculated difference value and the toner pattern concentration measuring reference value stored in the memory 22 in advance. For example, the processor 21 decreases or increases a developing bias voltage according to the difference between the calculated difference value and the toner pattern concentration measuring reference value stored in the memory 22 in advance.

Specifically, the value obtained by optically measuring the concentration (optical concentration) of the surface of the primary transfer belt 71 on which the toner pattern is not formed is "660", and the value of the optical concentration of the test pattern 77 on the primary transfer belt 71 is "350". In this case, the difference value is 660-350, thereby becoming "310". In addition, it is assumed that the toner pattern concentration measuring reference value stored in the memory 22 in advance is "300". In this case, the processor 21 performs feedback by reducing the developing bias voltage according to the value of "10" which is the difference between the difference value "310" and the toner pattern concentration measuring reference value "300".

The image forming conditions to be subjected to feedback, that is, various parameters for controlling each device are a voltage applied to the electrostatic charger 52, the developing bias voltage, exposure power, and the like.

The processor 21 sets the concentration sensor reference value used in the image quality stabilizing at an initial setting of the image forming apparatus 1, or at any timing.

Next, a specific flow of the image quality stabilizing will be described.

First, the processor 21 determines whether or not the image quality stabilizing is executed (ACT 21). The processor 21 determines whether or not it is timing to execute the image quality stabilizing based on various conditions. For example, the processor 21 determines that it is timing to execute the image quality stabilizing when printing is performed on a predetermined number or more of sheets. For example, the processor 21 may determine that it is timing to execute the image quality stabilizing when color printing is performed. For example, the processor 21 may determine that it is timing to execute the image quality stabilizing when a surrounding environment significantly changes (for example, when a temperature changes by a predetermined amount or more within a predetermined time).

Figure 7:
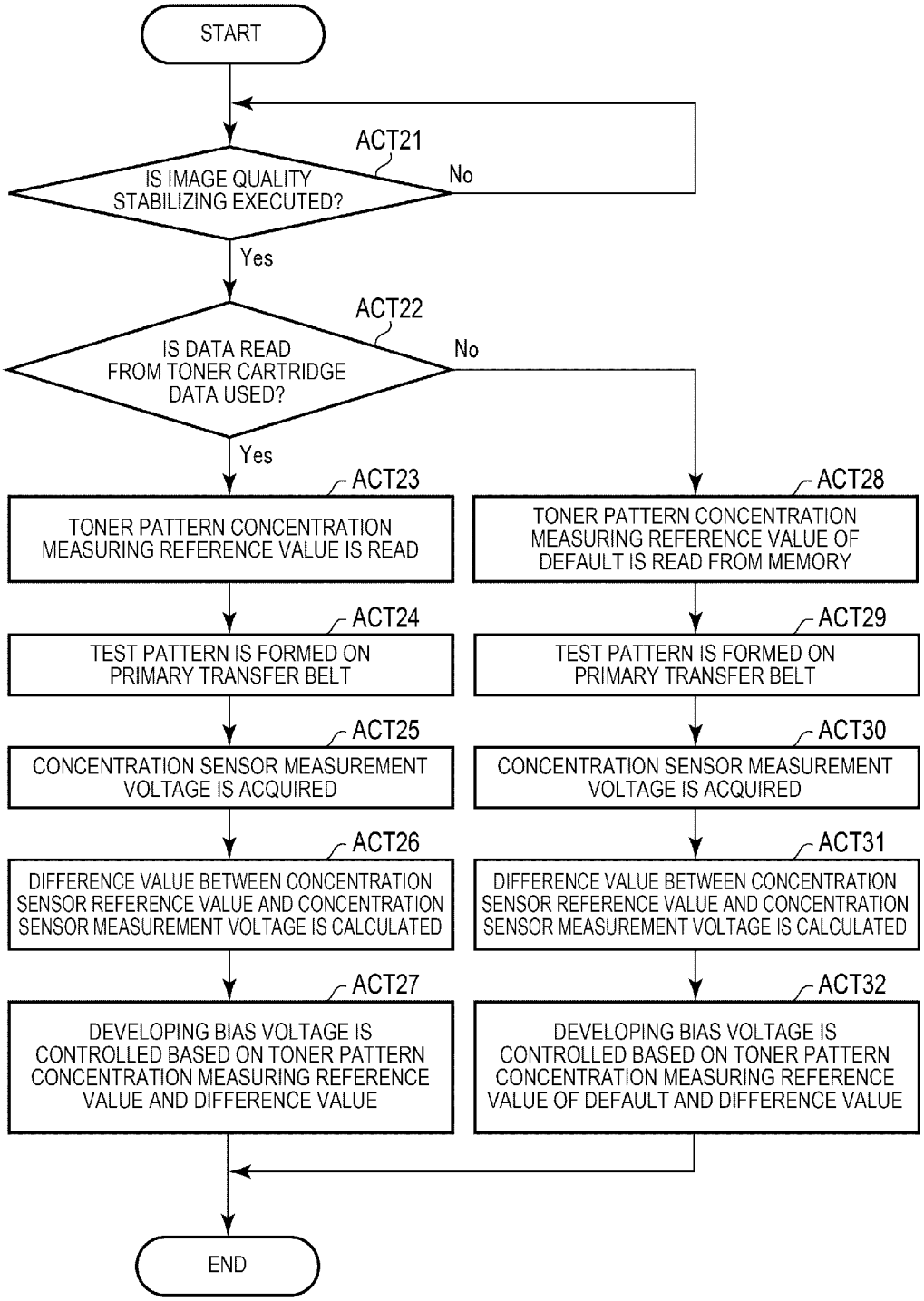
FIG. 7 is a flowchart of a method for explaining an example of image quality stabilizing according to an embodiment.

FIG. 7 illustrates an example of the image quality stabilizing. If it is determined that the image quality stabilizing is performed (ACT 21, YES), the processor 21 determines whether or not data read from the toner cartridge data is used (ACT 22).

As described above, if the authenticating with the toner cartridge 2 is the authentication success, the toner pattern concentration measuring reference value is already stored in the memory 22. If the authenticating with the toner cartridge 2 is the authentication success, the processor 21 reads the toner pattern concentration measuring reference value stored in the memory 22, and determines that it is used for the image quality stabilizing.

In addition, if the authenticating with the toner cartridge 2 is the authentication failure, the toner pattern concentration measuring reference value is not stored in the memory 22. Instead, the memory 22 stores in advance the toner pattern concentration measuring reference value of default. If the authenticating with the toner cartridge 2 is the authentication failure, the processor 21 reads the toner pattern concentration measuring reference value of the default stored in the memory 22, and determines that it is used for the image quality stabilizing.

If the processor 21 determines that the data read from the toner cartridge 2A is used, that is, it is the authentication success (ACT 22, YES), the toner pattern concentration measuring reference value acquired from the toner cartridge 2A is read from the memory 22 (ACT 23).

The processor 21 controls the image forming unit 19, so that the test pattern 77 is formed on the primary transfer belt 71 (ACT 24). The processor 21 causes the test pattern 77 to be formed on the primary transfer belt 71 by operating the image forming unit 19 based on a predetermined parameter. Before forming the test pattern 77, a toner replenishment necessity determining step is performed to determine the necessity of the toner replenishment. Therefore, a concentration ratio of the carrier to the toner in the developing device when the toner pattern is formed is set to an appropriate value, so that the influence by a toner specific concentration is not generated when the optical measurement is performed by the concentration sensor 43.

The processor 21 acquires the concentration sensor measuring voltage from the concentration sensor 43 (ACT 25). The concentration sensor 43 detects the test pattern 77 on the primary transfer belt 71 and supplies the concentration sensor measuring voltage to the processor 21.

Next, the processor 21 calculates the difference value between the concentration sensor measuring voltage and the concentration sensor reference value (ACT 26). The difference value corresponds to an output of the concentration sensor 43 changed due to the influence of the toner. That is, the difference value corresponds to the output of the concentration sensor 43, from which the influence of the reflection of the light by the primary transfer belt 71 is eliminated.

The processor 21 controls the image forming condition such as the developing bias voltage or the charging bias voltage used in the image forming in the process unit 41 based on the difference value and the toner pattern concentration measuring reference value acquired from the toner cartridge 2 (ACT 27), and ends the image quality stabilizing. For example, the processor 21 compares the difference value with the toner pattern concentration measuring reference value read from the memory 22, and controls various parameters used in the image forming in the process unit 41 based on the comparison result. Specifically, the processor 21 decreases the developing bias voltage when the difference value is larger than the toner pattern concentration measuring reference value acquired from the toner cartridge 2. Therefore, the concentration of the toner image formed on the primary transfer belt 71 decreases. In addition, the processor 21 increases the developing bias voltage when the difference value is smaller than the toner pattern concentration measuring reference value acquired from the toner cartridge 2. Therefore, the concentration of the toner image formed on the primary transfer belt 71 increases. The processor 21 may be configured to return to the process of ACT 23 after the process of ACT 27, form the test pattern again, and acquire the concentration sensor measuring voltage.

In addition, the processor 21 reads the toner pattern concentration measuring reference value of the default from the memory 22 (ACT 28) when it is determined that the toner cartridge 2 is not authenticated (ACT 22, NO). That is, the processor 21 reads the toner pattern concentration measuring reference value of the default stored in the memory 22 in advance when the toner cartridge 2 fails in authentication.

The processor 21 controls the image forming unit 19 so as to form the test pattern 77 on the primary transfer belt 71 (ACT 29). The processor 21 operates the image forming unit 19 based on a predetermined parameter to form the test pattern 77 on the primary transfer belt 71.

The processor 21 acquires the concentration sensor measuring voltage from the concentration sensor 43 (ACT 30). The concentration sensor 43 detects the test pattern 77 on the primary transfer belt 71 and supplies the concentration sensor measuring voltage to the processor 21.

Next, the processor 21 calculates the difference value between the concentration sensor measuring voltage and the concentration sensor reference value (ACT 31).

The processor 21 controls the developing bias voltage used in the image forming in the process unit 41 based on the difference value and the toner pattern concentration measuring reference value of the default (ACT 32), and ends the image quality stabilizing. The processor 21 may be configured to return to the process of ACT 28 after the process of ACT 32, form the test pattern again, and acquire the concentration sensor measuring voltage.

The toner pattern concentration measuring reference value of the default is a value which is set on the assumption of predetermined toner characteristics. However, the image quality of the image finally formed on the print medium varies depending on the toner characteristics. The toner characteristics vary depending on a production lot of the toner or the like. Therefore, even if the image quality stabilizing is performed based on the toner pattern concentration measuring reference value of the default, an optimal image may not be obtained. However, the toner cartridge 2 stores the toner pattern concentration measuring reference value determined based on the toner characteristics of the toner with which the toner cartridge 2 is filled. Therefore, the toner cartridge can provide the toner pattern concentration measuring reference value according to the toner characteristics of the toner used in actual image formation to the image forming apparatus 1. Therefore, the processor 21 of the system controller 13 of the image forming apparatus 1 can reflect the toner characteristics of the toner with which the toner cartridge 2 is actually filled on the image. As a result, the image forming apparatus 1 can print a high quality image.

In the above explanation, a configuration, in which the processor 21 reads the ATC sensor output correcting control value table and the toner pattern concentration measuring reference value from the IC chip 94 of the toner cartridge 2 when the power source is turned on or the toner cartridge is replaced, and stores those data in the memory 22, is described, but the embodiment is not limited to the configuration. The processor may be configured to read the ATC sensor output correcting control value table and the toner pattern concentration measuring reference value table from the IC chip 94 of the toner cartridge 2 at the time of the initial setting of the image forming apparatus 1, at the timing of turning-on of the image forming apparatus 1, at the timing of performing color print, at the timing of closing the front cover, at the timing of returning from a sleep state, or the like.

In the above embodiments, the processor 21 acquires the toner pattern concentration measuring reference value determined based on the toner characteristics from the toner cartridge 2, and uses the data in the image quality stabilizing, but the embodiments are not limited to the configuration.

The functions described in each of the above embodiments can be realized not only by hardware but also by reading a program describing each function into a computer using software. Each function may be configured by selecting either software or hardware as appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner cartridge, comprising:

a toner accommodating container accommodating a toner; and a memory having stored therein reference data corresponding to toner characteristics of the toner in the toner accommodating container, the reference data further corresponding to a predetermined threshold that regards a number of sheets of medium printed with the toner, and the memory further comprising instructions for forming a toner pattern formed by the toner on a medium, the toner pattern configured to provide an optical detection result used for applying reference values by an image forming apparatus.

2. The cartridge according to claim 1, wherein the toner is a decolorable toner.

3. The cartridge according to claim 1, wherein the toner is a non-decolorable toner.

4. The cartridge according to claim 1, wherein the toner characteristics include at least one of a toner particle diameter, information indicating a shape of toner particles, and a Brunauer-Emmett-Teller specific surface area value.

5. The cartridge according to claim 1, wherein the toner characteristics include color of the toner.

6. The cartridge according to claim 1, further comprising:

an integrated circuit chip comprising the memory and a processor, wherein the integrated circuit determines an automated toner control sensor output correcting control value based on a printing speed associated with the toner cartridge and the predetermined threshold.

7. An image forming apparatus configured to mount a toner cartridge for accommodating a toner and to form an image on a medium with the toner, the apparatus comprising:

a processor which changes an image forming condition based on an optical detection result of a toner pattern image formed on the medium by the toner of the toner cartridge, and reference data is the reference data received from a memory of the toner cartridge and used for applying a reference value for the optical detection result, wherein the reference data corresponds to toner characteristics of the toner in the toner cartridge and a predetermined threshold that regards a number of sheets of medium printed with the toner.

8. The apparatus according to claim 7, wherein the toner is a decolorable toner.

9. The apparatus according to claim 7, wherein the toner is a non-decolorable toner.

10. The apparatus according to claim 7, wherein the toner characteristics include at least one of a toner particle diameter, information indicating a shape of toner particles, and a Brunauer-Emmett-Teller specific surface area value.

11. The apparatus according to claim 7, wherein the toner characteristics include color of the toner.

12. The apparatus according to claim 7, wherein the processor adjusts an image forming condition by measuring a concentration of the toner pattern image.

13. The apparatus according to claim 7, further comprising:

a concentration sensor configured to measure a concentration of the toner pattern image.

14. An image processing method, comprising:

forming a toner pattern image on a photoconductive member with a toner supplied from a toner cartridge;

measuring a toner concentration in a developer in a developing device;

transferring the toner pattern image onto a medium;

changing an image forming condition based on a detection result obtained by optically detecting the toner pattern image transferred onto the medium;

supplying the toner from the toner cartridge based on the measuring and a predetermined reference value that is based on a predetermined threshold regarding a number of sheets of the medium printed with the toner;

receiving toner characteristics from the toner accommodating container and applying a reference value for an optical detection result of a toner pattern formed by the toner on the medium; and correcting the measurement result.

15. The method according to claim 14, further comprising:

adjusting the image forming condition by measuring a concentration of the toner pattern image.

16. The method according to claim 14, further comprising:

measuring a concentration of the toner pattern image.

17. The method according to claim 14, wherein the toner is a decolorable toner.

18. The method according to claim 14, wherein the toner is a non-decolorable toner.

19. The method according to claim 14, wherein the toner characteristics include at least one of a toner particle diameter, information indicating a shape of toner particles, and a Brunauer-Emmett-Teller specific surface area value.

20. The method according to claim 14, wherein the toner characteristics include color of the toner.

* * * * *